US006192846B1

(12) United States Patent
Speil

(10) Patent No.: US 6,192,846 B1
(45) Date of Patent: Feb. 27, 2001

(54) HOUSING FOR AN ENGAGEABLE AND DISENGAGEABLE BUCKET TAPPET

(75) Inventor: Walter Speil, Ingolstadt (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 09/462,277

(22) PCT Filed: Jun. 8, 1998

(86) PCT No.: PCT/EP98/03410

§ 371 Date: Jan. 3, 2000

§ 102(e) Date: Jan. 3, 2000

(87) PCT Pub. No.: WO99/04143

PCT Pub. Date: Jan. 28, 1999

(30) Foreign Application Priority Data

Jul. 15, 1997 (DE) ..... 197 30 200

(51) Int. Cl.[7] ..... F01L 1/14; F01L 13/00

(52) U.S. Cl. ..... 123/90.51; 123/90.48; 123/90.5

(58) Field of Search ..... 123/90.16, 90.48, 123/90.49, 90.5, 90.51, 90.55; 29/888.03, 888.43; 74/569

(56) References Cited

U.S. PATENT DOCUMENTS 5,431,133 * 7/1995 Spath et al. ..... 123/90.16
5,782,216 * 7/1998 Haas et al. ..... 123/90.16
5,832,884 * 11/1998 Haas et al. ..... 123/90.16

FOREIGN PATENT DOCUMENTS 2252760 10/1972 (DE) .
3820645 12/1989 (DE) .
4314619 11/1994 (DE) .
2158991 5/1973 (FR) .
WO 95/30081 11/1995 (WO) .

* cited by examiner

*Primary Examiner*—Wellun Lo
(74) *Attorney, Agent, or Firm*—Bierman, Muserlian and Lucas

(57) ABSTRACT

In a housing (1) for a switchable device for adjusting or compensating valve lash in an internal combustion engine, said housing being made as a one-piece component and comprising a sleeve-shaped inner guide (4) having a bore (7) for receiving an inner element which is contacted by a first, separate cam, said housing also comprising a cylindrical bottom portion (3) for making contact with at least one second, separate cam, and a circular cylindrical jacket (2) coaxially surrounding the inner guide (4), said inner guide comprising openings (6) for receiving locking pins which extend at right angles to the housing axis (5), according to the invention, the housing (1) is configured as a thin, drawn sheet metal part whose jacket (2) likewise comprises openings (8) which are aligned to the openings (6) of the inner guide (4). In this way, a light-weight housing is created which by joining with separate connection pieces forms a simple-to-manufacture base body for the device.

3 Claims, 1 Drawing Sheet

HOUSING FOR AN ENGAGEABLE AND DISENGAGEABLE BUCKET TAPPET

FIELD OF THE INVENTION

The invention concerns a housing for a switchable cup tappet of an internal combustion engine, said housing being made as a one-piece component and comprising a sleeve-shaped inner guide having a bore for receiving an inner element which is contacted by a first, separate cam, said housing also comprising a cylindrical bottom portion for making contact with at least one second, separate cam, and a circular cylindrical jacket coaxially surrounding the inner guide, said inner guide comprising openings for receiving locking pins which extend at right angles to the housing axis.

BACKGROUND OF THE INVENTION

A switchable cup tappet, also called a switching cup, is a device for adjusting or compensating valve lash in an internal combustion engine and can be switched to at least two different operational states for establishing different valve openings. In standard switching cups, the housing fulfils the function of transmitting the standard cam lift through the cylindrical bottom portion to the engine valve. Such tappet housings have to be secured against rotation.

In a switchable cup tappet known from DE-OS 43 14 619, a concentric reception bore is arranged at the center of the housing for receiving lift and force transmitting means which constitute the inner element and at the same time effect lash adjustment. In the case of this inner element, an inner housing arranged for axial displacement in the reception bore and an additional, separate cam permit the execution of a cam lift different from and, as a rule, smaller than the standard lift.

The inner element, or inner housing, can be displaced into and locked in different positions relative to the bottom. In a locked state, a higher lift is effected due to the action of the larger cam on the bottom portion. In the unlocked state, the smaller cam, which then acts directly on the inner element that is arranged for sliding in the reception bore, creates the lower lift of valve actuation.

In known switching cup housings, so-called eyes for the reception bores of the locking mechanism are made in one piece with the bottom and the inner guide. On the one hand, this increases the weight of the housing and, on the other hand, it necessitates complicated work procedures.

SUMMARY OF THE INVENTION

The object of the invention is to create a light-weight housing which by joining with separate connection pieces forms a simple-to-manufacture base body for a switching cup.

The invention achieves this object by the fact that the housing is configured as a thin, drawn sheet metal part whose jacket likewise comprises openings which are aligned to the openings of the inner guide.

For the low lift inner element to be arranged in the bore and for preventing a rotation of the inner element relative to the cup housing, a contact surface can be formed in the inner guide to extend into the bore. A simple-to-implement contact surface is made in the form of a flat surface.

BRIEF DESCRIPTION OF THE DRAWINGS

Examples of embodiment of the invention are represented in the drawings and will be described more closely in the following.

DETAILED DESCRIPTION OF THE DRAWINGS

Figure 1:
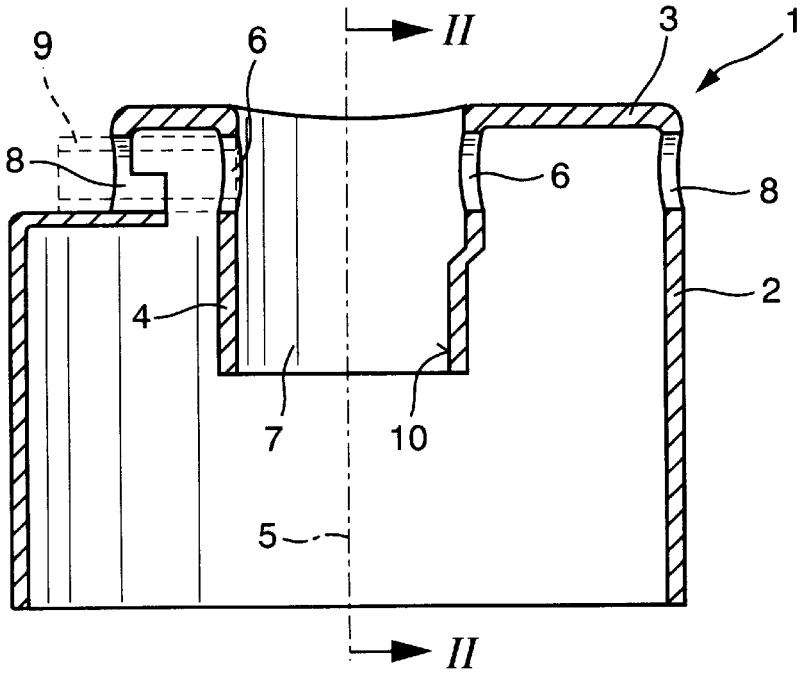
FIG. 1 is a longitudinal section through a housing of the invention for a cup tappet.
Figure 2:
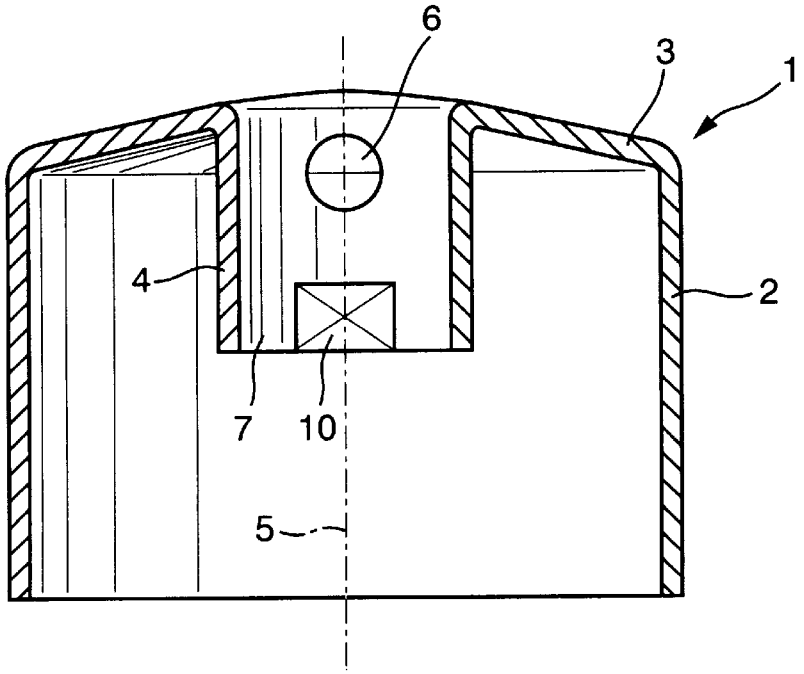
FIG. 2 is a longitudinal section through the housing taken along line II—II of FIG. 1.

A housing 1 according to the invention is made as a thin, drawn sheet metal part. In a preferred embodiment, the housing 1 comprises a circular cylindrical jacket 2 which is partially closed at one end by an integrally formed bottom. This bottom is formed by a cylindrical bottom portion 3 which merges integrally into an inner guide 4. The cylindrical bottom portion 3 extends in the form of an arch towards the preferably cylindrical jacket 2, while the inner guide 4 extends coaxially to the jacket 2 within the jacket. The common longitudinal axis of the inner guide 4 and the jacket 2 is the housing axis 5.

The inner guide 4 comprises two openings 6 which preferably extend at right angles to the housing axis 5, i.e. in radial direction of the housing 1. They are situated near the bottom portion 3 and serve to receive the guide sleeves 9 of locking pins with which an inner element to be arranged in the bore 7 of the inner guide 4 and comprising a lash adjusting element can be locked relative to the housing 1. As represented on the right-hand side of FIG. 1, the jacket 2 is cylindrical in shape over its entire length up to its transition into the bottom portion 3. But it is also possible to retract the jacket 2 in the vicinity of the bottom portion 3. This embodiment is represented on the left-hand side of FIG. 1.

Openings 8 are also provided in the jacket 2, each opening 8 of the jacket 2 corresponding to and being in alignment with an opening 6 of the inner guide 4. A locking pin can thus extend in radial direction in two associated openings 6 and 8 of the housing 1. To assure an exact guidance, a guide sleeve 9 is provided for each locking pin and is received by the openings 6 and 8. Such a guide sleeve 9 is indicated in broken lines on the left-hand side of FIG. 1. A particularly advantageous arrangement of such a "switching fitting" is obtained by drawing in a part of the jacket 2 into the interior of the housing 1 in the region of the opening 8 so as to assist the reception and the fixture of the guide sleeve 9.

A part of the length of the guide sleeve 9 can project out of the housing 1. This assures a sufficient guiding length and design space for the locking pins and also results in a simple and reliable fixing of the guide sleeve 9.

The low-lift part of the tappet which is to be arranged in the inner guide 4 and comprises the lash adjusting element properly speaking, must be secured against rotation. For this purpose, a contact surface 10 is formed in the inner guide 4 and extends in the region of the bore 7. The simplest configuration of this contact surface 10 is to make it as a flat surface. This surface prevents the low-lift tappet part, which must also be provided with a similar contact surface, known, per se, from rotating in the bore 7.

What is claimed is:

1. A housing (1) for a switchable cup tappet of an internal combustion engine, said housing being made as a one-piece component and comprising a sleeve-shaped inner guide (4) having a bore (7) for receiving an inner element which is contacted by a first, separate cam, said housing also comprising a cylindrical bottom portion (3) for making contact with at least one second, separate cam, and a circular cylindrical jacket (2) coaxially surrounding the inner guide (4), said inner guide comprising openings (6) for receiving locking pins which extend at right angles to the housing axis (5), characterized in that the housing (1) is configured as a thin, drawn sheet metal part whose jacket (2) likewise comprises openings (8) which are aligned to the openings (6) of the inner guide (4).

2. A housing according to claim 1, characterized in that, for the inner element to be arranged in the bore (7) and for preventing a rotation of the inner element relative to the bottom portion (3), a contact surface (10) is formed in the inner guide (4) to extend into the bore (7).

3. A housing according to claim 1, characterized in that the contact surface (10) of the inner guide (4) is made as a flat surface.

* * * * *